United States Patent [19]

Brodin

[11] 4,068,799

[45] Jan. 17, 1978

[54] AUTOMATIC VENTILATION REGULATING DEVICE FOR WINDOWS, DOORS AND THE LIKE

[76] Inventor: Eric Brodin, 44, Boulevard d'Italie, Monte Carlo, Monaco

[21] Appl. No.: 656,879

[22] Filed: Feb. 10, 1976

[30] Foreign Application Priority Data

Feb. 10, 1975 Sweden ..... 7501426

[51] Int. Cl.[2] ..... F01P 7/10

[52] U.S. Cl. ..... 236/49; 49/324; 49/362

[58] Field of Search ..... 236/49; 98/40 VT; 126/113; 49/324, 362; 16/87 R; 74/380

[56] References Cited

U.S. PATENT DOCUMENTS

| | | | |
|---|---|---|---|
| 489,625 | 1/1893 | Brinkman | 236/49 |
| 1,820,764 | 8/1931 | Abt | 236/49 |
| 1,961,546 | 6/1934 | Benson | 310/91 |
| 2,059,408 | 11/1936 | Stark | 126/113 |
| 2,158,543 | 5/1939 | Jensen | 126/113 |
| 2,584,691 | 2/1952 | Galeazi | 236/49 |
| 2,603,983 | 7/1952 | Rieser | 310/91 |
| 3,247,732 | 4/1966 | Barnhart | 49/362 |
| 3,330,071 | 7/1967 | Kubisiak | 49/362 |
| 3,691,684 | 9/1972 | Boneck | 49/362 |
| 3,777,974 | 12/1973 | Sparks | 236/49 |
| 3,918,201 | 11/1975 | Graziano | 49/362 |
| 3,996,697 | 12/1976 | Bailey et al. | 49/362 |

*Primary Examiner*—William E. Wayner
*Assistant Examiner*—Robert J. Charvat
*Attorney, Agent, or Firm*—Browdy and Neimark

[57] ABSTRACT

An automatic ventilation regulating device for windows, doors and the like, which have a movable portion and a fixed portion, including a spindle; a slide displaceable on the spindle; driving means for displacing the slide on the spindle, the spindle and the slide being connectable with the movable and fixed portions, respectively; and a settable thermostat arranged for controlling the operation of the driving means in response to the temperature in the room to be ventilated.

5 Claims, 2 Drawing Figures

AUTOMATIC VENTILATION REGULATING DEVICE FOR WINDOWS, DOORS AND THE LIKE

The present invention relates to an automatic ventilation regulating device for windows, doors and the like having an openable portion and a fixed portion.

Devices for keeping a window casement or a door in a certain definite open position for obtaining desired ventilation in the room behind are previously known. These devices require manual adjustment of the casement or door, however, and manualadjustment each time the opening angle of the casement or door is altered. This is naturally a drawback, especially when there is nobody in the vicinity to make the necessary adjustment. If no adjustment is made, there is a large risk of the room being too cold or too poorly ventilated. The problem is especially acute for bedrooms in dwellings, in which it is desired to keep a constant night-time temperature independent of temperature variations outdoors, and at the same time ensure good ventilation.

The main object of the invention is therefore to provide a device for ventilation regulation which makes it possible to automatically vary the degree to which a casement, door or the like is open, in response to the temperature of the room behind. Further objects of the invention are to provide a simple and cheap device which is easy to fit, and furthermore prevents the casement or door being opened from outside by an unauthorized person.

According to the invention, these objects are achieved by providing the device with a threaded spindle, a slide displaceable on the spindle, and driving means for displacing the slide on the spindle, the spindle being connectable to one portion and the slide being connectable to the other portion, and with a settable thermostat arranged for controlling the operation of the driving means in response to the temperature in the ventilated room.

Figure 1:
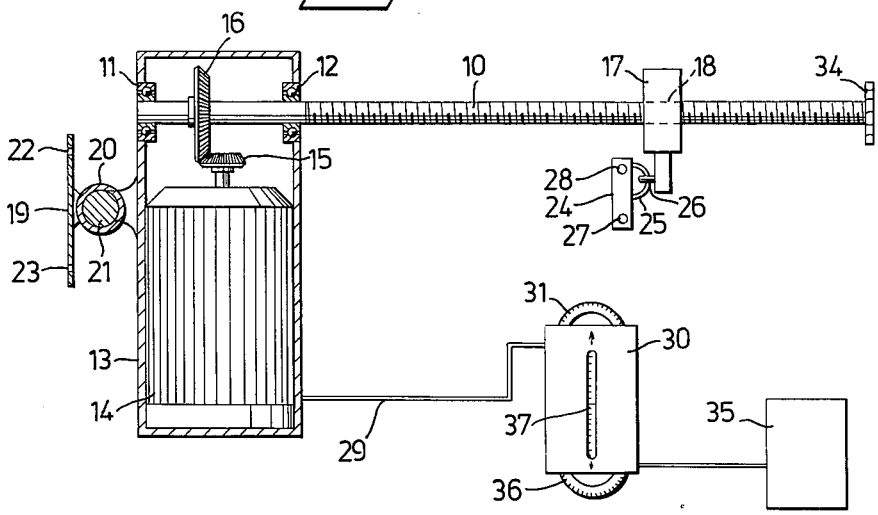
Figure 2:
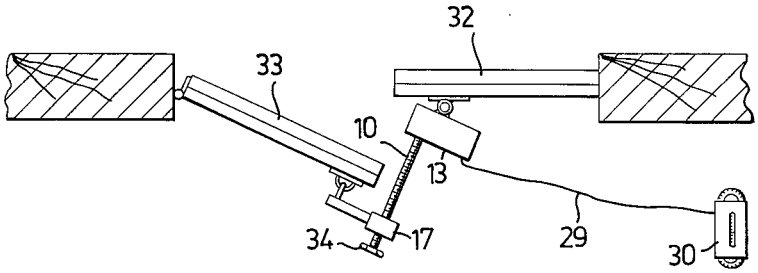

Still further objects and advantages of the invention will now be more closely described in conjunction with the attached drawings, where FIG. 1 shows an embodiment of the invention and FIG. 2 shows the device of FIG. 1 attached to a window.

The device shown in FIG. 1 comprises a threaded spindle 10 rotatably mounted by means of two bearings 11, 12 in a housing 13, which also contains an electric motor 14. The motor is arranged to drive the threaded spindle by means of a gear consisting of two bevel pinions 15, 16. A slide 17 is displaceably mounted on the spindle 10. The slide is provided with a thread which corresponds to the thread on the spindle. The slide is displaced on the spindle when the latter rotates, enabling the slide to be displaced in one or other direction depending on the direction of rotation of the spindle.

The motor housing 13 is provided with a fastening plate 19, which by means of a sleeve 20 is pivotably attached to a carrying pin 21 projecting from the housing. The fastening plate is provided with holes 22, 23 for screws or other fastening details. The displaceable slide 17 is also provided with a fastening plate 24, pivotably attached to the slide by means of a ring 25 running through an eyelet 26 attached to the slide. The fastening plate 24 is also provided with holes 27, 28 for screws or other fastening details.

The electric motor 14 is intended to be driven from the mains and is provided with a connecting line not shown on the drawing. The motor is further connected to a thermostat 30, which is provided with a wheel 31 for setting the desired temperature through a line 29. The thermostat is further supplied with contactors (not shown) for connecting the electric motor to the supply in such a way that it rotates in one direction when the temperature in the room is above the set desired temperature so that the window or door is opened further, and rotates in the other direction when the temperature in the room is below the desired temperature so that the window or door is moved towards closure. The motor should be so arranged that it is switched on for short periods, the time between these periods being sufficiently long for the temperature in the room to have time to change in response to the adjustment made.

The fastening plates 19, 24 on the motor housing 13 and the slide 17 are intended one for attachment to the movable part and the other to the fixed part of a window or door, where it is desirable to enable regulation of the opening angle or the degree of opening in response to the temperature in the room.

In FIG. 2, the device according to FIG. 1 is shown attached to a window with an inwardly opening window with a fixed portion 32 and an openable or movable portion of casement 33. The motor housing 13 is attached to the fixed portion 32 and the slide 17 is attached to the casement 33. When the motor is switched on by the thermostat 30, the spindle 10 will rotate or turn in one or the other direction, the slide 17 being displaced on the spindle so that the casement 33 of the window is displaced in an opening or closing direction. During this movement, the angular position of the slide 17 is continously altered in relation to the casement 33, and the angular position of the spindle 10 is altered in relation to the fixed portion 32 due to the pivotably arranged fastening plates.

The free end of the spindle 10 can preferably be provided with an operating wheel 34 so that the spindle easily can be turned by hand to enable manual regulation of the casement, e.g. for completely closing the window. The slide 17 is preferably attached to the casement 33 in such a way that it can be easily uncoupled from the casement from the inside so that the casement can be opened and closed without obstruction from the automatic regulation device. It is, however, important that the uncoupling arrangement is so designed and positioned that it is not accessable to a person outside the window.

The device according to the invention can also be used for outwardly-going casements and doors, although here the device should be placed closer to the edge of the casement or door provided with hinges so that the device will not be accessable for somebody outside the window or door. The regulation device is preferably so designed that the maximum opening is about 10 cm (4 inches). Since the connecting means between the casement and the fixed portion consists of a spindle, the diameter of which can be of the order of magnitude 10 mm (⅜ inch) or more, it will be very difficult for an unauthorized person, without using heavy tools and doing great damage to the device or the casement or door respectively, to open the casement or door a sufficient amount for entering the room. The embodiment shown in FIG. 1 is also provided with a device for regulating the humidity of the air in the room so that the air in the room is automatically kept as comfortable as possible. This additional equipment consists of a humidifier 35 connected via means 36 sensing the air humidity in the room and being settable for switching on the humidifier when the air humidity in the room comes below a desired set value. The humidity sensing means 36 is built into the thermostat 30 so that only one control unit is necessary, which can also be provided with a thermometer 37. The humidifier and regulating means for it can be of conventional type.

Even if only one embodiment of the device has been shown and described, it is obvious that many variations and modifications are possible within the scope of the inventive concept. It is, for example, possible to arrange the threaded spindle non-rotatably, and to attach the driving motor to a slide for driving a sleeve rotatably attached to the slide, the sleeve encompassing the spindle and being provided with a thread meshing with the thread on the spindle and on rotation diaplacing the slide on the spindle. The pivotable connection between the fastening plates and the slide and motor housing, respectively, can be accomplished in many different ways, e.g. by pin mountings, ball mountings or rings and eyes. What is essential is that the slide and spindle can swing in a common plane. Furthermore, it is not necessary for one end of the ventilation regulating device to be attached to the fixed portion of the window or door, but it can just as well be attached to some other surface which is fixed in relation to the movable portion, e.g. a frame, a wall surface, a windowsill or the like.

The device according to the invention can also be used for regulating ventilation in connection with sashes and hatches and the like, which are not swingable but are displaceable parallel in relation to a wall surface. In such a case the sash or hatch is provided with guiding means at one edge and a device according to the invention at another edge, there being no need for any pivotable connection between the fastening plates and the slide and spindle, respectively.

Instead of an electric motor driven from the mains, a spring motor can be used which makes it possible to utilize the device in houses where there is no electricity, e.g. in recreational dwellings. The necessary electrical current for the thermostat circuit can then be provided by a battery cell.

If the rotation of the motor used cannot easily be reversed, a device for reversing the rotation of the spindle must be inserted in the transmission between motor and spindle. Such reversing means are, however, known per se.

The threaded spindle does not need to have a continuous thread but can be provided with a number of thread portions or cogs or teeth and, alternatively, a tooth rack can be provided.

I claim:

1. An automatic ventilation regulating device for windows, doors and like having an openable portion and a fixed portion, said device including: a threaded spindle rotatably mounted; a slide displaceable on said spindle when said spindle is rotated, said spindle being pivotally connected with one portion and said slide being pivotally connected with the other portion; and means to automatically vary the degree to which the window or door is opened in response to temperature, said means comprising intermittently operated motor means for rotating said spindle for short periods, and a settable thermostat for controlling the operation of said motor means to drive said motor means intermittently for short periods in response to the temperature in the ventilated room.

2. A device as claimed in claim 1, in which said slide is provided with a through hole through which said spindle passes and which is provided with a thread corresponding to the thread on said spindle.

3. A device as claimed in claim 1, particularly for inwardly opening window casements and doors, in which said motor means is arranged to be attached to said fixed portion of the window or door and said slide is arranged to be attached to said movable portion of the window or door.

4. A device as claimed in claim 1, in which said motor means consists of an intermittently operating electric motor.

5. A device as claimed in claim 1, in which said thermostat is positioned at a distance from said motor means and arranged to control said motor means in such a way that said slide is displaced in the closing direction, when the temperature in the room is below the one set on the thermostat, and in the opening direction, when the temperature in the room is above the set temperature.

* * * * *